United States Patent [19]

Dehring

[11] Patent Number: 4,759,193

[45] Date of Patent: Jul. 26, 1988

[54] HORIZONTAL REFRIGERATOR

[76] Inventor: Paul E. Dehring, 47 NE. 11 Way, Deerfield Beach, Fla. 33441

[21] Appl. No.: 94,203

[22] Filed: Sep. 8, 1987

[51] Int. Cl.[4] ..... F25D 23/02

[52] U.S. Cl. ..... 62/258; 62/441

[58] Field of Search ..... 62/440, 441, 447, 258

[56] References Cited

U.S. PATENT DOCUMENTS

| | | | |
|---|---|---|---|
| 1,058,906 | 4/1913 | Schlichting | 62/258 X |
| 2,478,145 | 8/1949 | Weber | 312/236 X |
| 2,518,242 | 8/1950 | McMahon | 62/441 X |
| 2,554,290 | 5/1951 | Becker | 62/258 X |
| 2,618,936 | 11/1952 | Kennedy | 62/89 |
| 2,961,851 | 11/1960 | Ehrenfreund | 62/448 |
| 4,457,140 | 7/1984 | Rastelli | 62/261 |

*Primary Examiner*—William E. Tapolcai
*Attorney, Agent, or Firm*—John Cyril Malloy

[57] ABSTRACT

In one embodiment, the refrigerator-freezer unit includes a rectangular, countertop height structure having an insulated freezer compartment and an insulated refrigeration compartment. The freezer compartment is accessed via a first countertop height cover that is hinged to the back wall of the structure. Access to the refrigeration compartment is provided via three separate countertop height covers each hinged to the back wall of the structure. These four covers constitute the entire top of the refrigerator-freezer unit. The refrigeration compartment is a shallow, undivided tub. Two support struts laterally extend across the top of the refrigeration compartment and support underside edge portions of the covers for the refrigeration compartment. A plurality of non-refrigerated, dry goods storage cabinets are disposed immediately below the refrigeration compartment. Access to these dry goods is provided along a front side of the structure. The unit also includes a refrigeration and freezing device which cools the refrigeration compartment and freezes the freezer compartment.

5 Claims, 1 Drawing Sheet

HORIZONTAL REFRIGERATOR

BACKGROUND OF THE INVENTION

The present invention relates to a self-contained, countertop height, refrigerator-freezer combination with underlying dry goods storage.

U.S. Pat. No. 2,618,936 to Kennedy shows a combination quick freeze and refrigerator cabinet. The rectangular structure includes a refrigerator compartment and a freezer compartment. The top of the structure is at countertop height and is segmented such that a first portion of the cover opens to provide access to the refrigeration compartment and a second portion or second cover opens to provide access to the freezer compartment. The refrigerator compartment is divided into sections and is very deep extending from the top of the cabinet to the bottom. U.S. Pat. No. 2,554,290 to Becker discloses a portable refrigerator unit having a shallow refrigerator tub and a single cover that opens to provide access to the entire refrigerator. U.S. Pat. No. 4,457,140 to Rastelli discloses a modular refrigeration unit wherein the refrigerating device is removable and slides out of the front side of the unit. U.S. Pat. No. 2,961,851 to Ehrenfreund discloses a refrigeration unit that has doors on the front side that provide access to the refrigeration compartment and another door that provides access to the freezer compartment.

OBJECTS OF THE INVENTION

It is an object of the present invention to provide a self-contained, countertop height, refrigerator-freezer with underlying storage capacity for dry goods that are not to be refrigerated.

It is a further object of the present invention to provide a shallow refrigeration compartment that is not divided.

It is another object of the present invention to provide at least three hinged covers along the countertop of the unit which provide access to areas in the refrigeration compartment immediately below the covers.

SUMMARY OF THE INVENTION

In one embodiment, the refrigerator-freezer unit includes a rectangular, countertop height structure having an insulated freezer compartment and an insulated refrigeration compartment. The freezer compartment is accessed via a first countertop height cover that is hinged to the back wall of the structure. Access to the refrigeration compartment is provided via three separate countertop height covers each hinged to the back wall of the structure. These four covers constitute the entire top of the refrigerator-freezer unit. The refrigeration compartment is a shallow, undivided tub. Two support struts laterally extend across the top of the refrigeration compartment and support underside edge portions of the covers for the refrigeration compartment. A plurality of non-refrigerated, dry goods storage cabinets are disposed immediately below the refrigeration compartment. Access to these dry goods is provided along a front side of the structure. The unit also includes a refrigeration and freezing device which cools the refrigeration compartment and freezes the freezer compartment.

BRIEF DESCRIPTION OF THE DRAWINGS

Further objects and advantages of the present invention can be found in the detailed description of the preferred embodiment when taken in conjunction with the accompanying drawings in which.

DETAILED DESCRIPTION OF THE PREFERRED EMBODIMENT

The present invention relates to a self-contained, countertop height, refrigerator-freezer unit having cabinet space immediately below the refrigerator compartment.

Figure 1:
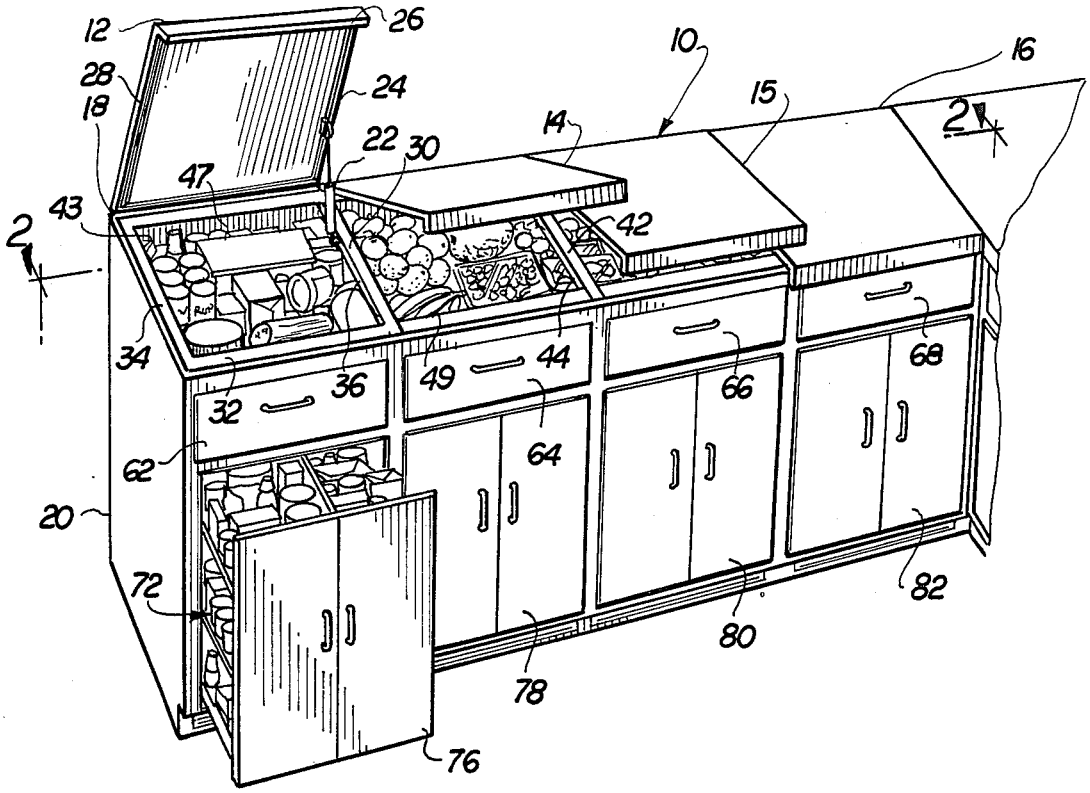
FIG. 1 illustrates a perspective view of the refrigerator-freezer unit.
Figure 2:
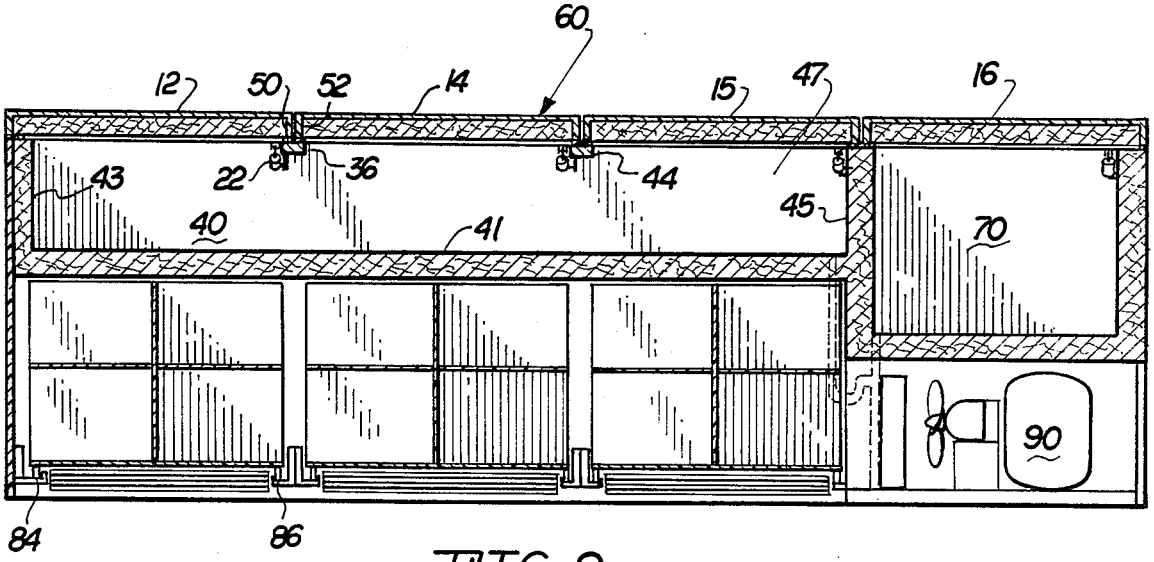
FIG. 2 illustrates a cross-sectional view of an emptied refrigerator-freezer unit from the perspective of section lines 2'-2" in FIG. 1.

FIG. 1 illustrates a perspective view of refrigerator-freezer unit 10. One of the important aspects of unit 10 is the segmented countertop embodied by covers 12, 14, 15, and 16. Similar numerals designate similar items throughout all the drawings. Covers 12, 14, 15, and 16 are hinged along back wall 18 of the rectangular structure 20 that is self-contained as the refrigerator-freezer unit 16. In order to maintain the covers in an open position, each cover has attached thereto a retaining mechanism that is shown with respect to cover 12 as mechanism 22. In the preferred embodiment, retaining mechanism 22 is a gas spring. The underside edge surfaces 24, 26 and 28 of cover 12 have seals which mate with top surfaces 30, 32 and 34. Top surface 30 is part of strut 36 that spans the top of refrigeration compartment 40 as shown in FIG. 2. Top surface 30 also is a support and seal surface for the underside adjacent edge of cover 14. Surface 42 of strut 44 provides a similar support structure for the underside edges of covers 14 and 15 adjacent that strut.

As shown in FIG. 2, refrigeration compartment 40 is shallow and is preferably between 10 inches deep. Compartment 40 is defined by floor 41 and sides 43, 45, 47 and 49. Floor 41 is approximately 10 inches from the underside surfaces of covers 12, 14 and 15. This height is slightly larger than a one gallon container of milk. Therefore, all items stored within the compartment are visible and immediately accessible upon opening of the covers.

The adjacent side surfaces of covers 12, 14 and 15, for example, the outside surfaces of side walls 50 and 52 respectively of covers 12 and 14 are in close proximity to provide a substantially continuous countertop 60. Cover 16 is the top of freezer compartment 70 shown in FIG. 2. It also provides for the continuous countertop surface 60 for the self-contained refrigerator-freezer unit.

False fronts 62, 64, 66, and 68 are simply for decoration.

Another important aspect of the invention is the dry goods storage cabinets disposed immediately below the shallow refrigeration tub. In this embodiment, non-refrigerated dry goods storage is provided in cabinets 72 by roll-out cabinet racks 76, 78 and 80. A false front 82 near freezer compartment 70 is for decoration. Pull-out cabinets 76, 78 and 80 are mounted on rollers 84 and 86 as shown with respect to pull-out cabinet 76. As used herein, the term "dry goods" refers to any items that do not need to be refrigerated and may include liquid items that are not perishable.

Refrigeration compartment 40 and freezer compartment 70 are respectively cooled and frozen via a refrigeration unit 90 that is shown diagrammatically in FIG.

2. The refrigeration compartment and the freezer compartment are insulated as shown.

The construction of the horizontal, counter height, shallow compartment, refrigerator provides the following:

1. Compactness: The unobstructed, horizontal, shallow refrigerator tub having 8.3 cu.ft. will store more items than a 16 cu.ft. vertical refrigerator with its numerous shelves.

2. Accessibility: Since all refrigerated items sit on the bottom of this shallow tub at approximately waist high, every item is plainly visible since, when the door is open, the user looks down and sees every thing. No items are hidden behind other items as is so common in current vertical domestic refrigerators.

3. Convenience: Since these refrigerated items are at waist height, the user need not stoop to retrieve food.

4. Energy Efficiency: Considering the physics of heat transfer, i.e., cold air descend, this refrigerator is extremely efficient in that whenever the door or cover is open there is not the usual replacement of cold air with warm air.

5. Ease of Cleaning: The floor of the refrigeration compartment preferably includes a perimeter gutter to drain along smooth, one piece stainless steel sides of the compartment thereby making cleaning simple.

The claims appended hereto are meant to cover changes and modifications within the scope and spirit of the present invention.

What I claim is:

1. A horizontal, self-contained countertop height refrigerator-freezer with underlying dry goods storage comprising:

a rectangular, countertop height structure having:

an insulated freezer compartment with a first countertop height cover hinged to a back wall of said structure a horizontal, insulated refrigeration compartment for non-frozen, refrigerated goods with second, third and fourth countertop height covers, each hinged to said back wall of said structure;

said first through fourth covers constituting a substantially planar countertop for said structure;

said refrigeration compartment having four shallow vertically extensive walls and a floor defining a shallow, undivided tub space, said floor being completely accessible via said second, third and fourth covers such that said tub space is maximally accessible due to the horizontal disposition thereof;

two support strut means laterally extending across the top of said refrigeration compartment for respectively supporting a combination of underside edge portions of said second and third covers and a combination of underside edge portions of said third and fourth covers;

a plurality of non-refrigerated, dry goods storage cabinets disposed immediately below said refrigeration compartment having means for providing access along a front side of said structure;

means for cooling said refrigeration compartment and for freezing said freezer compartment disposed below said freezer compartment;

the adjacent sides of all of said covers being closely disposed next to each other to provide a substantially continuous countertop for said structure; and said plurality of cabinets include pull-out cabinets laterally movably mounted with respect to said structure and said means for access includes handles for pulling out each cabinet independent of the other cabinets.

2. A countertop height refrigerator-freezer as claimed in claim 1 wherein the depth of said refrigeration compartment is approximately 10 inches.

3. A countertop height refrigerator-freezer as claimed in claim 2 wherein the depth of said freezer compartment is greater than that of said refrigerator compartment.

4. A countertop height refrigerator-freezer as claimed in claim 3 including controllable means for maintaining each cover in an open position to provide access to the corresponding compartment.

5. A countertop height refrigerator-freezer as claimed in claim 1 including controllable means for maintaining each cover in an open position to provide access to the corresponding compartment.

* * * * *